United States Patent [19]

Gee

[11] 4,295,481

[45] Oct. 20, 1981

[54] CONVERTIBLE SUN SHADE

[76] Inventor: Charles E. Gee, 1481 Russell Dr. N., St. Petersburg, Fla. 33710

[21] Appl. No.: 816,339

[22] Filed: Jul. 18, 1977

[51] Int. Cl.[3] ..... E04F 10/10

[52] U.S. Cl. ..... 135/5 R; 135/5.1; 135/7.1 R; 297/184

[58] Field of Search ..... 135/5 R, 5.1, 5 E, 7.1 R; 297/184; 5/332; 248/291

[56] References Cited

U.S. PATENT DOCUMENTS

| | | | |
|---|---|---|---|
| 1,719,614 | 7/1929 | McIntosh | 5/332 |
| 2,598,588 | 5/1952 | Mullen | 135/5 R |
| 3,162,206 | 12/1964 | Betts | 135/7.1 R |
| 3,243,230 | 3/1966 | Otto | 135/5 R X |
| 3,480,023 | 11/1969 | McConnell et al. | 135/7.1 R X |

FOREIGN PATENT DOCUMENTS

| | | | |
|---|---|---|---|
| 1345145 | 10/1963 | France | 135/7.1 R |

*Primary Examiner*—C. J. Husar
*Assistant Examiner*—Conrad Berman
*Attorney, Agent, or Firm*—Stanley M. Miller

[57] ABSTRACT

A sun shade is disclosed which is readily convertible from a ground supported shade to a chair-back supported shade for use while sunbathing. The sun shade includes a U-shaped support member having the bottom portion of the U as a rearward support for the shade and the legs of the U being forwardly positioned. A pair of upright support members are each pivotally mounted on each of the legs of the U-shaped member, proximate to the bottom portion of the U. A canopy is pivotally mounted between the upright support members on the upper end thereof, for shielding sunlight from the region between the legs of the U-shaped member. When the shade is employed in its ground supported embodiment, a pair of anchor spikes are pivotally mounted, one on each of the legs of the U-shaped member, as a forward ground support for the shade, the spikes being driven into the ground for anchorage. The bottom portion of the U for the U-shaped member serves as the rearward ground support for the shade. When the shade is employed in its chair-back support embodiment, a pair of clamps are used to clamp each of the legs of the U-shaped member to the frame of the back of a chair so that the canopy shades the back of the chair. A special clamping mechanism is employed to lock the pivotal mounting of the canopy to the upright support members, thereby making the canopy manually adjustable to follow the position of the sun.

11 Claims, 5 Drawing Figures

FIG. 3
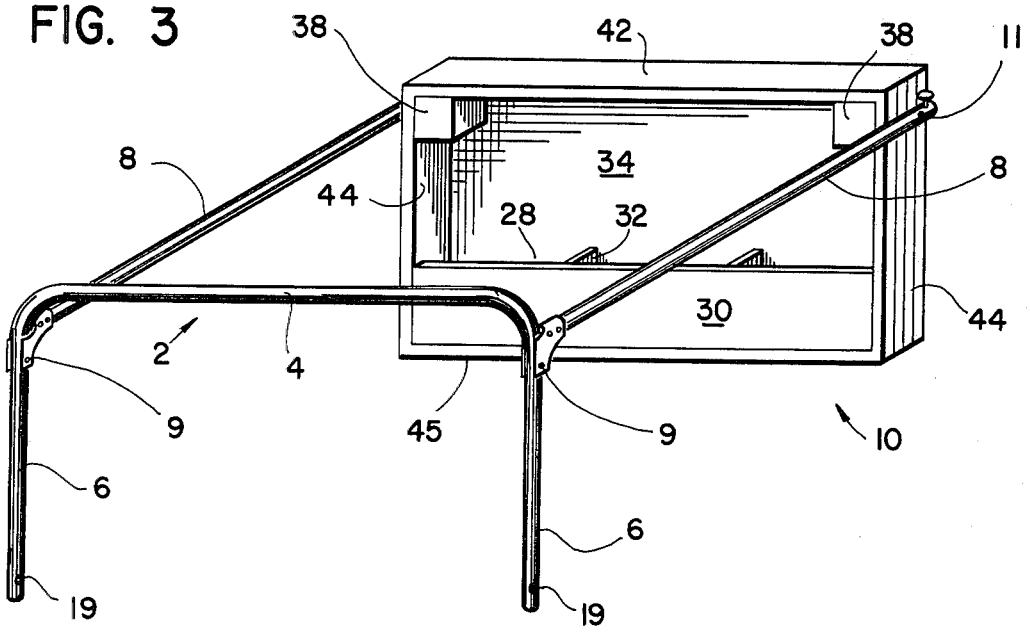
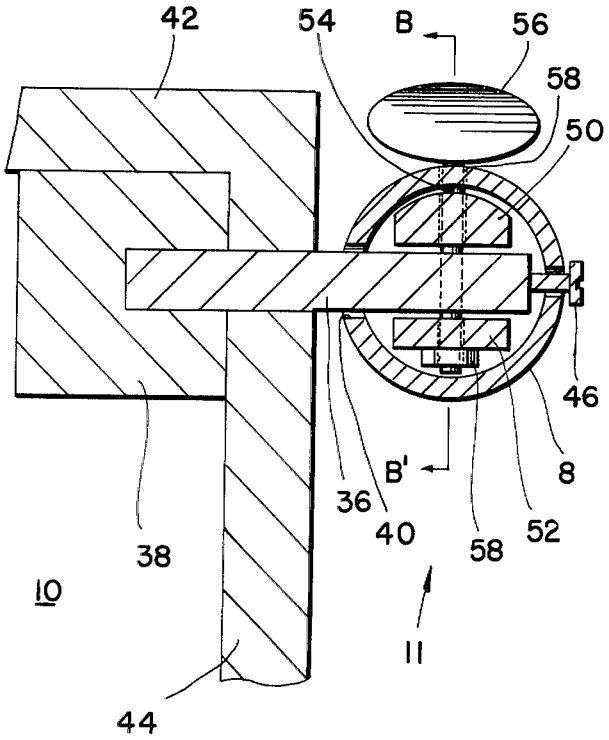
FIG. 4
SECTION A-A'
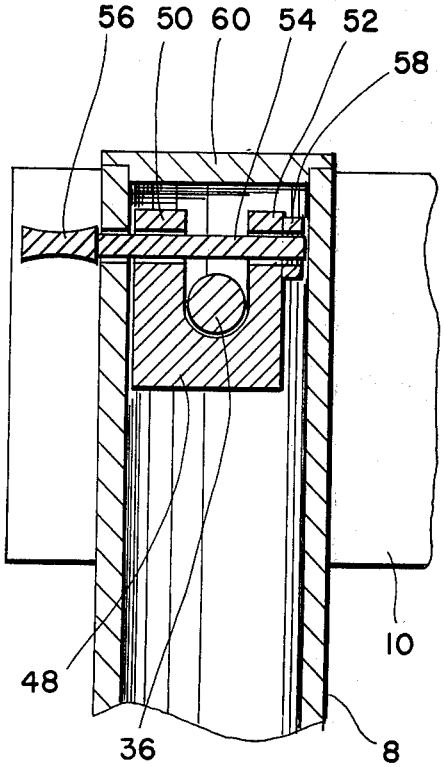
FIG. 5
SECTION B-B'

CONVERTIBLE SUN SHADE

FIELD OF THE INVENTION

The invention disclosed broadly relates to solar shades and more particularly relates to a vertically adjustable solar shade.

BACKGROUND OF THE INVENTION

The twentieth century has witnessed a dramatic reduction in the working hours for the laboring classes with shorter work days and longer vacations providing an increasing amount of leisure time. With this development has come the increased popularity of sunbathing at private or public swimming pools and on ocean beaches. Although moderate exposure of the body to solar radiation is healthful and has been found to increase the production of vitamin D in the skin, excessive exposure to solar radiation has been found to contribute to unhealthful skin conditions such as premature aging of the skin and a higher incidence of melanoma or skin cancer. Thus it becomes important to be able to control the amount of solar radiation incident on one's skin while relaxing on the beach during one's leasure time. Conventional, umbrella-type parasols have been employed as a means to shade the body during a beach outing, however these devices have proven to be cumbersome and inconvenient to adjust as the sun progresses across the sky during the course of the day. Smaller sized, ground supported shades having adjustable canopies have been employed in the prior art but have proven to be inflexible since the user may, during one portion of the day, desire to lie upon the beach sand, while during another portion of the day would prefer to sit in a beach chair. The prior art ground supported canopies are not adaptable to use on a beach chair and either a separate parasol must be employed to provide shade or the bather must use the chair without shade.

OBJECTS OF THE INVENTION

It is therefor an object of the invention to provide an improved sun shade.

It is another object of the invention to provide an improved sun shade which is readily convertible from a ground supported shade to a chair-back supported shade.

It is yet another object of the invention to provide a sun shade which is easily locked into a variety of positions so as to enable it to follow the sun during the course of the day.

SUMMARY OF THE INVENTION

These and other objects, features and advantages of the invention are accomplished by the convertible sun shade disclosed herein.

A sun shade is disclosed which is readily convertible from a ground supported shade to a chair-back supported shade for use while sunbathing. The sun shade includes a U-shaped support member having the bottom portion of the U as a rearward support for the shade and the legs of the U being forwardly positioned. A pair of upright support members are each pivotally mounted on each of the legs of the U-shaped member, proximate to the bottom portion of the U. A canopy is pivotally mounted between the upright support members on the upper end thereof, for shielding sunlight from the region between the legs of the U-shaped member. When the shade is employed in its ground supported embodiment, a pair of anchor spikes are pivotally mounted, one on each of the legs of the U-shaped member, as a forward ground support for the shade, the spikes being driven into the ground for anchorage. The bottom portion of the U for the U-shaped member serves as the rearward ground support for the shade. When the shade is employed in its chair-back support embodiment, a pair of clamps are used to clamp each of the legs of the U-shaped member to the frame of the back of a chair so that the canopy shades the back of the chair. A special clamping mechanism is employed to lock the pivotal mounting of the canopy to the upright support members, thereby making the canopy manually adjustable to follow the position of the sun.

DESCRIPTION OF THE FIGURES

These and other objects, features and advantages of the invention will be more particularly appreciated with reference to the accompanying figures.

FIG. 3 is an isometric bottom view of the convertible sun shade, showing the structure of the canopy.

FIG. 4 is a cross sectional view along the section A–A′ of FIG. 2, showing a detailed view of the structure of the pivotal mounting of the canopy to the upright support members.

FIG. 5 is a cross sectional view along the section B–B′ of FIG. 4 of the locking mechanism for the pivot mounting the canopy to the upright support member.

DISCUSSION OF THE PREFERRED EMBODIMENT

Figure 1:
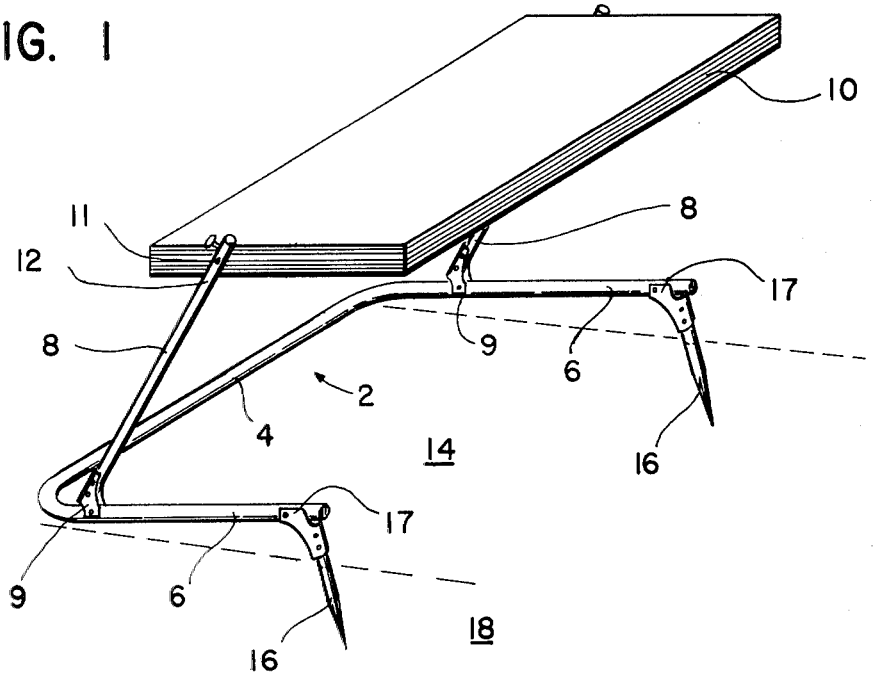
FIG. 1 is an isometric view of the side of the convertible sun shade invention, in its ground support embodiment.
Figure 2:
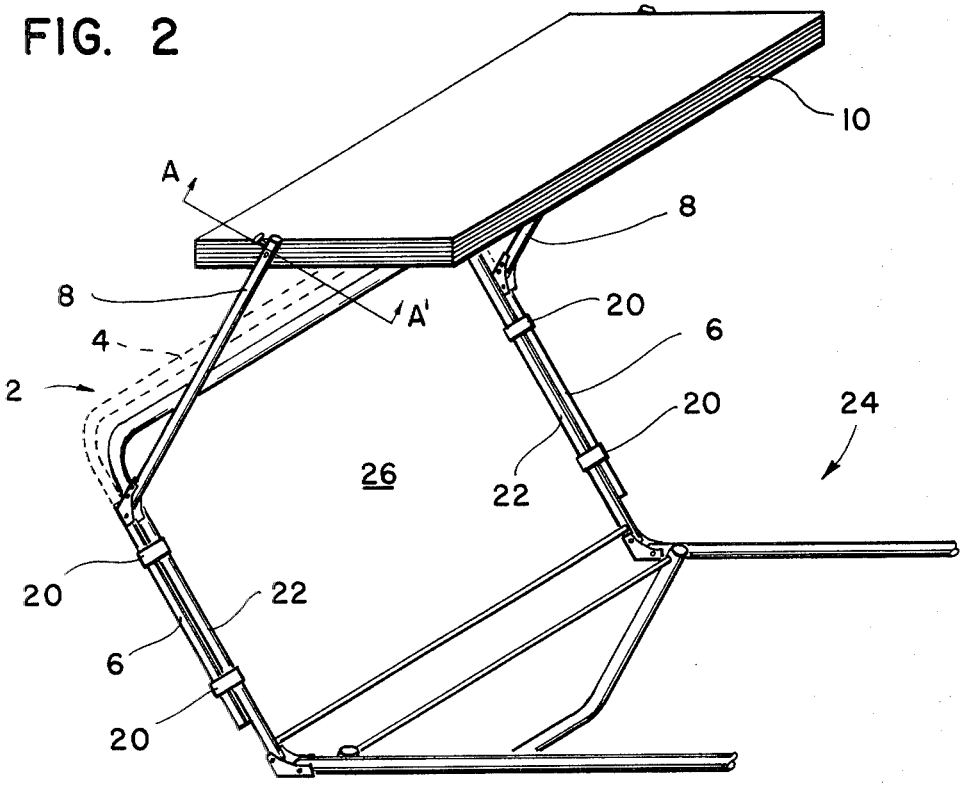
FIG. 2 is an isometric view of the side of the convertible sun shade invention, in its chair-back supported embodiment.

FIG. 1 illustrates an isometric side view of the convertible sun shade in its ground supported embodiment and FIG. 2 illustrates the convertible sun shade in its chair-back supported embodiment. The convertible sun shade includes a U-shaped support member 2 having the bottom portion 4 of the U as a rearward support for the shade and the legs 6 of the U being forwardly positioned. A pair of upright support members 8 are each pivotally mounted by means of the pivot 9 on each of the legs 6 of the U-shaped member 2, proximate to the bottom portion 4 of the U. The pivot 9 can be a shaft formed by a screw and wing-nut to enable the manual adjustment and locking into position of the upright support members 8. A canopy 10 is pivotally mounted with the pivot 11 between the upright support members 8 on the upper ends 12 thereof. The canopy shields sunlight from the region 14 between the legs 6 of the U-shaped member 2.

In the ground supported embodiment of FIG. 1, a pair of anchor spikes 16 are each pivotally mounted by means of the pivot mounting 17 on each of the legs 6 of the U-shaped member 2. The pivot 17 can be a shaft formed by a screw and wing-nut passing through hole 19 in the leg 6 of U-shaped member 2, to enable the manual adjustment and locking into position of the anchor spikes 16. The anchor spikes 16 serve as the forward ground support for the shade, being driven into the ground 18 for anchorage. The bottom portion 4 of the U for the U-shaped member 2 serves as a rearward support for the shade, in contact with the ground 18.

In the chair-back supported embodiment for the shade in FIG. 2, a pair of clamps 20 clamp each one of the legs 6 of the U-shaped member 2 to the frame 22 of the back of the chair 24. Anchor spikes 16 can be optionally removed for this application by removing the pivot screw at 17 from the hole 19 in the legs 6. In this manner, the canopy 10 shades the back 26 of the chair 24. In an alternate embodiment, a pair of straight tubular members can be substituted for the U-shaped member 2, serving as the leg portions 6 thereof, with the clamps 20 clamping them to the chair-back frame 22. This is illustrated in FIG. 2 by showing the bottom portion 4 of the U as dotted indicating that it may be omitted in the alternate embodiment, for mounting on the chair 24. Including the bottom portion 4 in the U-shaped member 2 gives the assembly greater strength and makes mounting the legs 6 to the frame 22 relatively easy. Omitting the bottom portion 4 from the U-shaped member 2 enables the canopy 10 and upright support members 8 to fold behind the chair back 26 when not in use. The chair frame is shown with the conventional fabric covering removed, for clarity.

The structure of the canopy 10 is shown to better advantage in FIG. 3. The canopy may be constructed out of a plastic such as polypropylene or out of metal such as aluminum or wood. The canopy 10 is essentially a box-like structure having the sides 42, 44 and 45 joined in a substantially rectangular structure with a top portion 34. The canopy 10 may optionally include storage compartments 28 formed by attaching to the underside of the canopy a wall 30 between the side pieces 44 and partitions 32 between the wall 30 and the top 34. The storage compartments can serve as a convenient means for storing beach items such as sun glasses, suntan oil, etc.

The canopy 10 is pivotally mounted to the upright support members 8 by means of a pivotal structure which includes a locking mechanism for locking the canopy in consecutively advancing positions so as to enable the canopy to be manually adjusted to follow the sun during the course of the day. The pivot 11 and locking mechanism are shown to better advantage in FIGS. 4 and 5. The upright support member 8 is a hollow tubular structure which may be composed of aluminum, for example. A shaft 36 composed of wood, preferably a hard wood such as maple, is rigidly mounted in a base block 38 mounted at the corner where the side pieces 42 and 44 of the canopy 10 are joined. The shaft 36 passes through a hole 40 in the side of the upright support member 8. To prevent the shaft 36 from engaging in axial motion, a screw 46 may be inserted through the opposite side of the upright support member 8 and into the end of the shaft 36. The shaft 36 constitutes the pivotal support for the canopy to the upright support member 8.

The locking mechanism for the pivot 11 comprises a substantially U-shaped resilient clamping member 48 which may be composed of wood, and is preferably a hard wood such as maple. The resilient clamping member 48 is placed within the hollow tubular structure 8 at the upper end 12 thereof. The clamping member 48 has two legs 50 and 52, one on each side of the shaft 36. An adjusting screw 54 having a wing top 56, passes through a hole 58 in the side of the upright support member 8 and through a first one of the legs 50 of the clamp 48. The screw 54 threadably engages a nut 58 positioned on the opposite side of the second one of the lugs 52 of the clamp 48. By advancing the screw 54 in the nut 58, the legs 50 and 52 of the clamping means 48 are drawn together, thereby squeezing and frictionally engaging the shaft 36 so as to lock the relative positions of the canopy with respect to the upright support member 8. The upper portion 12 of the upright support member 8 may be closed by means of the cap 60 to prevent sand or moisture from contacting the clamping means 48.

The resulting sun shade is readily convertible from a ground supported sun shade to a chair-back supported sun shade and has the capacity of being manually adjustable over a wide range of relative positions so as to enable its following the position of the sun during the course of the day on the beach.

Although a particular embodiment of the invention has been disclosed for purposes of illustrating the inventive concept, those of skill in the art would agree that minor changes in the form or structure or selection of materials can be made to the disclosed embodiment without departing from the spirit and scope of the invention.

I claim:

1. A self-supporting sun shade, comprising:

a U-shaped support member having the bottom portion of the U as a rearward support for the shade and the legs of the U being forwardly positioned;

a pair of upright support members, one pivotally mounted on each of said legs of said U-shaped member, proximate to said bottom portion of the U;

a canopy pivotally mounted between said upright support members, on the upper ends thereof, for shielding sunlight from the region between said legs of said U-shaped member;

said pivotal mounting for said canopy to said upright support member, further comprising:

said upright support member being a hollow tubular structure;

a shaft rigidly mounted to said canopy and passing through a hole in the side of said upright support member;

a substantially U-shaped, resilient clamping member within said hollow tubular structure at the upper end thereof, having two legs, one on each side of said shaft;

a screw passing through the side of said upright support member and through a first one of said legs of said clamp and threadably engaging a second one of said legs of said clamp, for tightening said clamp about said shaft;

a cap sealably engaging said upper end of said hollow tubular structure for protecting said clamping member from environmental elements;

whereby said canopy can be locked into a fixed position with respect to said upright support member.

2. The sun shade of claim 1, wherein said canopy further comprises:

a storage compartment attached to the underside of said canopy.

3. The sun shade of claim 1, which further comprises:

a pair of anchor spikes, one pivotally mounted on each of said legs of said U-shaped member, as a forward ground support for the shade, driven into the ground for anchorage;

said bottom portion of the U for said U-shaped member serving as a rearward ground support for the shade;

said canopy further comprising a storage compartment attached to the underside of said canopy.

4. The sun shade of claim 1, which further comprises:

a pair of anchor spikes, one pivotally mounted on each of said legs of said U-shaped member, as a forward ground support for the shade, driven into the ground for anchorage;

said bottom portion of the U for said U-shaped member serving as a rearward ground support for the shade.

5. The sun shade of claim 4, which further comprises:

said canopy further comprising a storage compartment attached to the underside of said canopy.

6. The sun shade of claim 4, wherein said sun shade can be converted from a ground supported shade to a chair-back supported shade, by means of a pair of clamps, each clamping one of said legs of said U-shaped member to the frame of the back of said chair.

7. The sun shade of claim 1, which further comprises:

a pair of clamps, each clamping one of said legs of said U-shaped member to the frame of the back of a chair;

whereby said canopy shades the back of the chair.

8. The sun shade of claim 7, wherein said sun shade can be converted from a chair-back supported shade to a ground supported shade, by a pair of anchor spikes, one pivotally mounted on each of said legs of said U-shaped member, as a forward ground support for the shade, driven into the ground for anchorage, said bottom portion of the U for said U-shaped member serving as a rearward ground support for the shade.

9. The sun shade of claim 7, wherein said bottom portion of the U for said U-shaped member is removed, leaving said legs clamped to said chair frame.

10. The sun shade of claim 1, which further comprises:

a pair of clamps, each clamping one of said legs of said U-shaped member to the frame of the back of a chair;

said canopy further comprising a storage compartment attached to the underside of said canopy;

whereby said canopy shades the back of the chair.

11. The sun shade of claim 10, wherein said bottom portion of the U for said U-shaped member is removed, leaving said legs clamped to said chair frame.

* * * * *